United States Patent [19]

Hughes

[11] 4,183,607

[45] Jan. 15, 1980

[54] CONNECTING MEANS FOR FINE WIRES

[75] Inventor: Donald W. K. Hughes, Mechanicsburg, Pa.

[73] Assignee: AMP Incorporated, Harrisburg, Pa.

[21] Appl. No.: 925,503

[22] Filed: Jul. 17, 1978

[51] Int. Cl.[2] ..... H01R 9/08

[52] U.S. Cl. ..... 339/97 R; 339/98

[58] Field of Search ..... 339/97 R, 97 P, 98, 339/99 R

[56] References Cited

U.S. PATENT DOCUMENTS

| | | | |
|---|---|---|---|
| 3,388,370 | 6/1968 | Elm | 339/98 |
| 3,798,587 | 3/1974 | Ellis, Jr. et al. | 339/97 P |
| 3,979,615 | 9/1976 | Neff | 339/95 D |
| 4,013,332 | 3/1977 | Dauser, Jr. | 339/98 |
| 4,017,140 | 4/1977 | Reavis, Jr. et al. | 339/98 |
| 4,026,013 | 5/1977 | Hughes | 339/276 R |
| 4,026,629 | 5/1977 | Dechelette et al. | 339/97 P |
| 4,116,522 | 9/1978 | Reynolds | 339/97 R |
| 4,118,103 | 10/1978 | Leidy et al. | 339/98 |

*Primary Examiner*—Joseph H. McGlynn
*Attorney, Agent, or Firm*—Frederick W. Raring

[57] ABSTRACT

An electrical connecting means for establishing contact between a terminal and a relatively fine wire having a thin film of varnish-type insulation thereon comprises a plastic housing having a terminal-receiving surface and a terminal-receiving cavity extending into the terminal-receiving surface. A wire-admitting slot means in opposite sidewalls of the housing communicates with the cavity so that the wire can be positioned in the cavity with its axis extending transversely across the cavity. A wire supporting ledge is provided on one internal wall of the cavity which serves as a stop for the wire. The terminal is dimensioned to have a force fit in the cavity and has insulation penetrating and contact surface portions which move past the wire when the terminal is inserted. The insulation penetrating portions penetrate the insulation and the contact surface portions establish contact with the wire. The ledge supports the wire against movement into the cavity as the terminal is inserted.

10 Claims, 14 Drawing Figures

Fig. 5
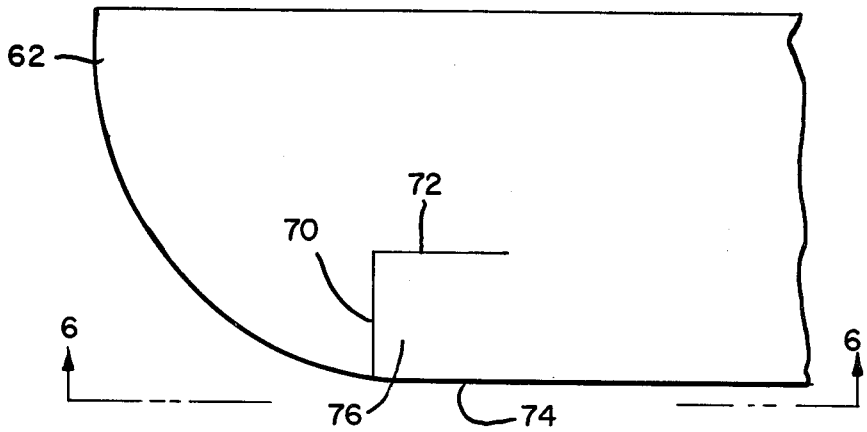
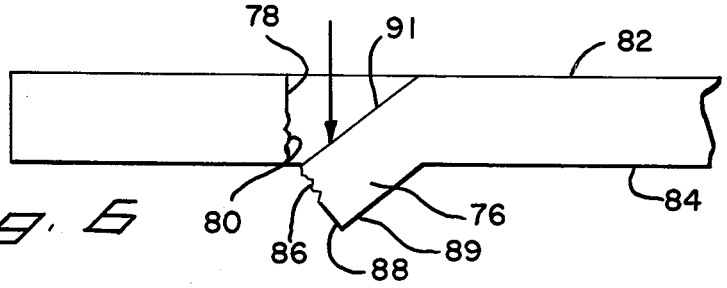
Fig. 6
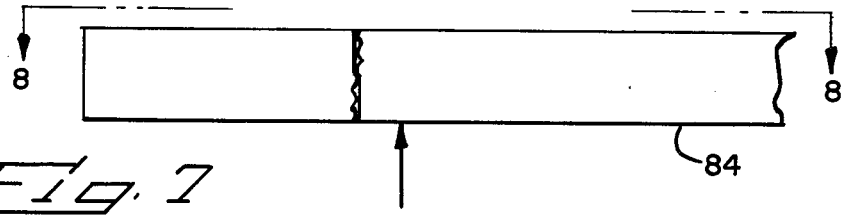
Fig. 7
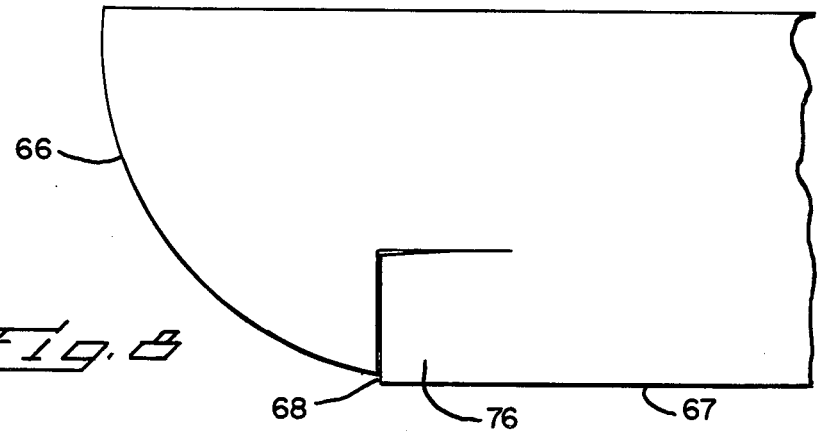
Fig. 8

Fig. 10
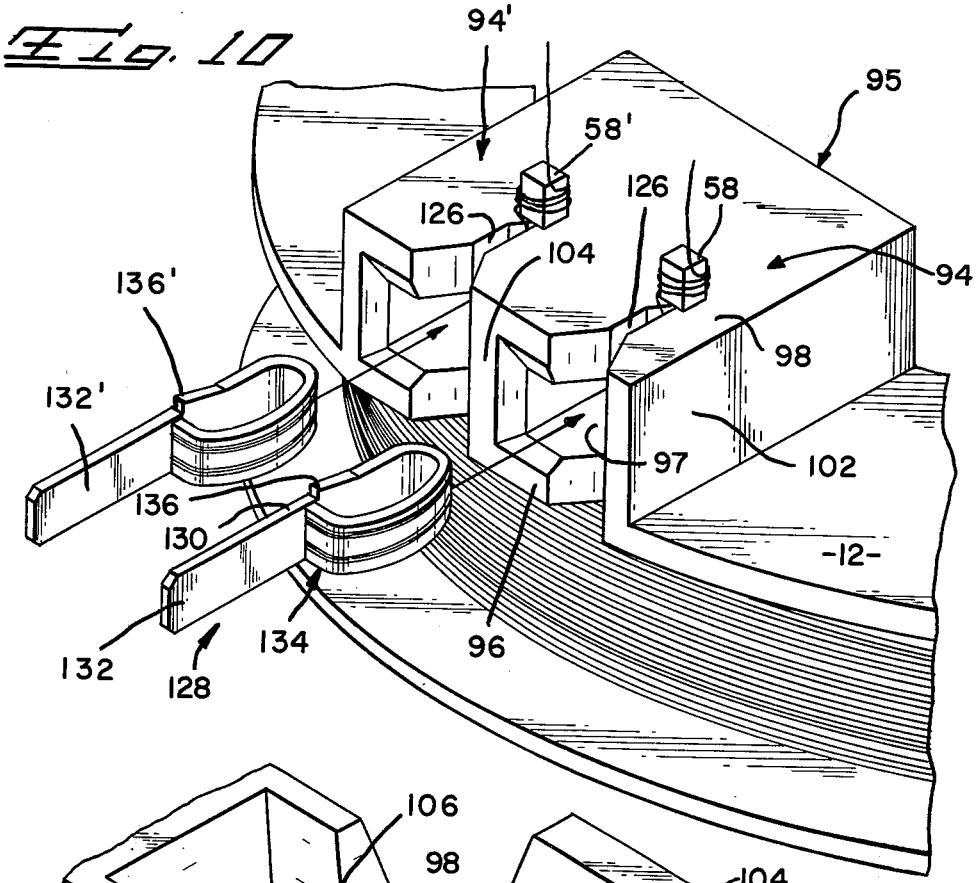
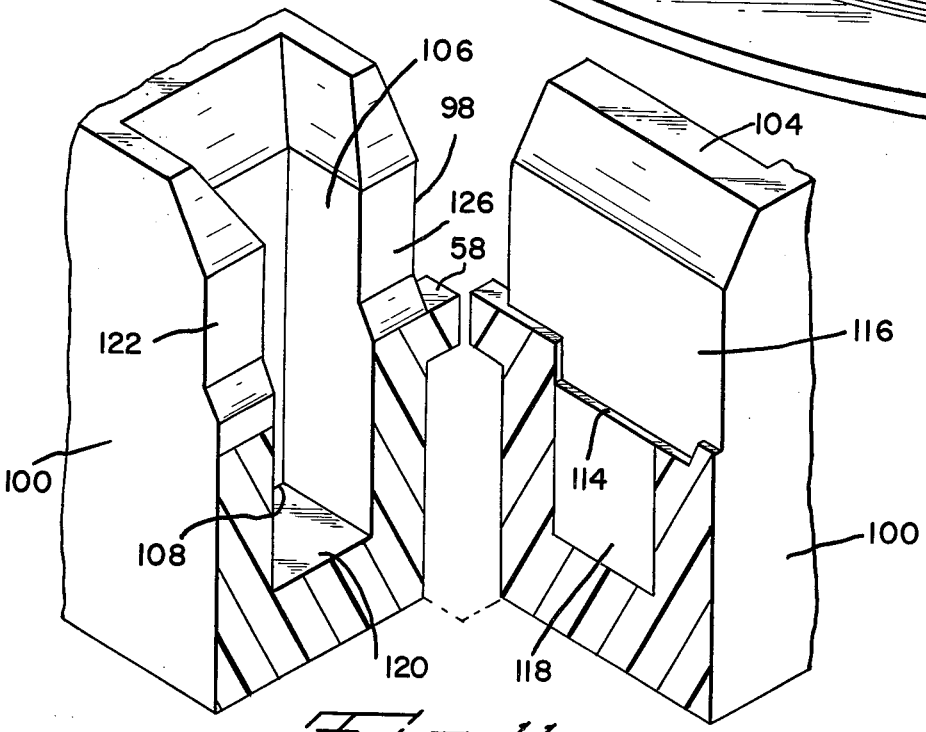
Fig. 11

CONNECTING MEANS FOR FINE WIRES

DESCRIPTION

1. Technical Field of the Invention

This invention relates to electrical connecting means for making electrical connections to single strand wires of the type having a thin film of varnish-type insulating material thereon. The embodiments of the invention disclosed herein are intended for establishing contact with the fine wire of a coil wound on a coil bobbin. The principles of the invention can be used under other circumstances, such as where electrical contact must be established with other types of coils such as the windings of a small electrical motor.

2. Background of the Invention

It is now common practice in the electrical industry to establish electrical contact with coil wires of the type having a varnish-type insulating coating thereon by providing an insulating housing having a terminal-receiving cavity in which the wire is placed with its axis extending across the cavity and supported on the wire-supporting surface in the cavity. The terminal has a wire-receiving slot therein which is inserted into the cavity so that the slot receives the wire, penetrates the insulation of the wire, and establishes electrical contact with the conducting core. The terminal ordinarily also has means for establishing an electrical connection to a relatively coarse gage lead wire which extends from the coil wire. The U.S. Pat. to Neff No. 3,979,615 discloses this prior art connecting means for connecting our winding of a stator coil to a lead wire. The teachings of the Neff patent are applicable where the winding wire has a thickness of at least about 0.32 mm (AWG 28 and coarser wire sizes). If the wire is relatively finer than AWG 28 or AWG 30, the difficulties of producing a wire-receiving slot in the terminal which is sufficiently narrow to establish contact with the wire render this terminal technique impractical.

The U.S. Pat. to Hughes No. 4,026,013 discloses a connecting means for establishing electrical connection to relatively fine coil wires in which the wire is again supported in a cavity provided in an insulating housing. The terminal is in the form of a trapezoid having opposed acute internal angles and having serrations on one surface thereof. The wire is located with its axis extending along one internal sidewall of the cavity and towards the inner end thereof. The trapezoidal terminal is inserted into the cavity and after insertion, it is deformed until the acute internal angle becomes a right angle and the serrated surface is forced against the wire to establish contact therewith. The connecting means shown in the Hughes U.S. Pat. No. 4,026,013 is being widely used however, it requires insertion tooling for the terminal which must first insert the terminal or push it into the cavity and then deform the terminal to urge the serrated surface against the wire.

BRIEF DESCRIPTION OF THE INVENTION

The present invention is directed to the achievement of an improved connecting means for relatively fine wires which does not require the two stage or compound tooling presently being used, and as shown in Hughes U.S. Pat. No. 4,026,013, and which can be used with extremely fine varnish-type insulated wires. The invention is further directed to a connecting means having a terminal which is relatively simple in its structure which can be manufactured with ease, which is durable and which will establish a stable electrical connection and which occupies a minimum amount of space.

In accordance with principles of the invention, an insulating housing is provided having a terminal-receiving cavity which is dimensioned to receive the contact terminal. The terminal has wire-admitting slot means in its sidewalls so that the wire can be positioned with its axis extending transversely across the cavity. A ledge is provided on one of the internal walls of the cavity and in alignment with the wire-admitting slot means. This ledge supports the wire along its axis when the terminal is inserted so that while the terminal moves into the cavity, it will penetrate the insulation of the wire and establish contact with the conducting core thereof. In accordance with one embodiment of the invention, the terminal comprises a reversely bent strip of resilient conductive metal formed in the shape of a "D" and has insulation penetrating ribs extending along the convex external surface thereof. The D-configuration provides a relatively stiff spring so that after the terminal is inserted, the resilient deformation of the spring provides a continuing contact pressure of the terminal against the wire supported on the ledge. In accordance with a further embodiment, the cavity has a centrally located rib extending between its sidewalls and the wire supporting ledge is on one of the sides of this rib. The terminal has a slot extending inwardly from its leading end which is dimensioned to receive the central rib in the cavity and one of the edges of the slot has an extremely narrow shoulder adjacent to the leading end of the terminal which serves to penetrate the wire insulation. The thickness of the rib is slightly greater than the width of the slot so that the rib is compressed and/or the terminal is resiliently deformed to provide a spring system which maintains the terminal in contact with the wire.

DESCRIPTION OF THE DRAWING FIGURES

FIG. 5 is a plan view of a portion of the leading end of the terminal on one side of the slot and illustrating a shearing operation which is carried out to produce a narrow shoulder on the terminal.

FIG. 6 is a view taken along the lines 6—6 of FIG. 5.

FIG. 7 is a view similar to FIG. 6 but showing the parts after a sheared out portion of the blank has been pressed back into the plane of the blank.

FIG. 8 is a plan view taken along the lines 8—8 of FIG. 7 and illustrating the insulation penetrating shoulder which is produced.

FIG. 10 is a view similar to FIG. 1 but showing an alternative form of connecting means in accordance with the invention.

FIG. 11 is a fragmentary perspective view of a portion of the housing of the embodiment of FIG. 10.

BEST MODE OF PRACTICE OF THE INVENTION

Figure 1:
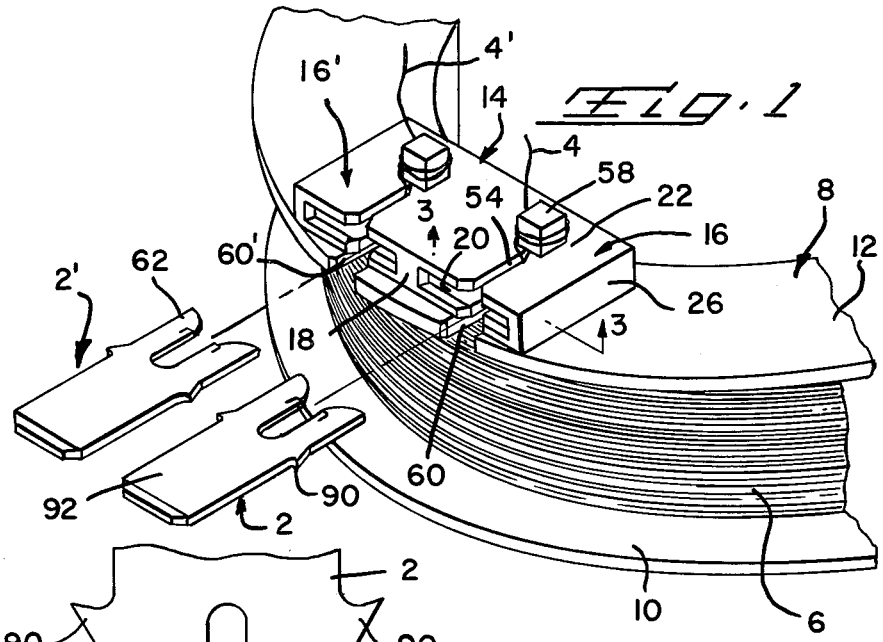
FIG. 1 is a fragmentary perspective view of a portion of a coil bobbin having electrical connecting means, in accordance with the invention, mounted thereon, this view showing the terminals as exploded from the housing.

FIGS. 1-8 show an embodiment of the invention in which the ends of a coil wire 4, 4' are electrically connected to terminals 2, 2' which in turn are adapted to be connected to terminals on the ends of lead wires. The coil 6 is wound on a bobbin 8 having parallel flanged 10, 12 and the connecting means for each end of the wire comprises a housing 16, 16' and the previously identified terminals 2, 2'. The housings 16, 16' are both formed in a housing block 14 which is integral with the upper flange 12 of the bobbin. Since the two housings 16, 16' are identical, a description of one will suffice for both, and the same reference numerals, differentiated by prime marks, will be used to identify the corresponding structural elements. The housing 16 on the right hand side of the housing block is described below.

Housing 16 has a terminal-receiving face 18 which extends normally of the upper surface of flange 12 and a terminal-receiving cavity 20 extends inwardly from the terminal-receiving face. The housing has a front external sidewall 22 which is spaced from the surface of flange 12, a back sidewall 24 which is integral with the surface of flange 12, an endwall 26 which is the one end of the housing block 14 and an endwall 28 which is a common endwall for both of the housings 16, 16'.

Figure 2:
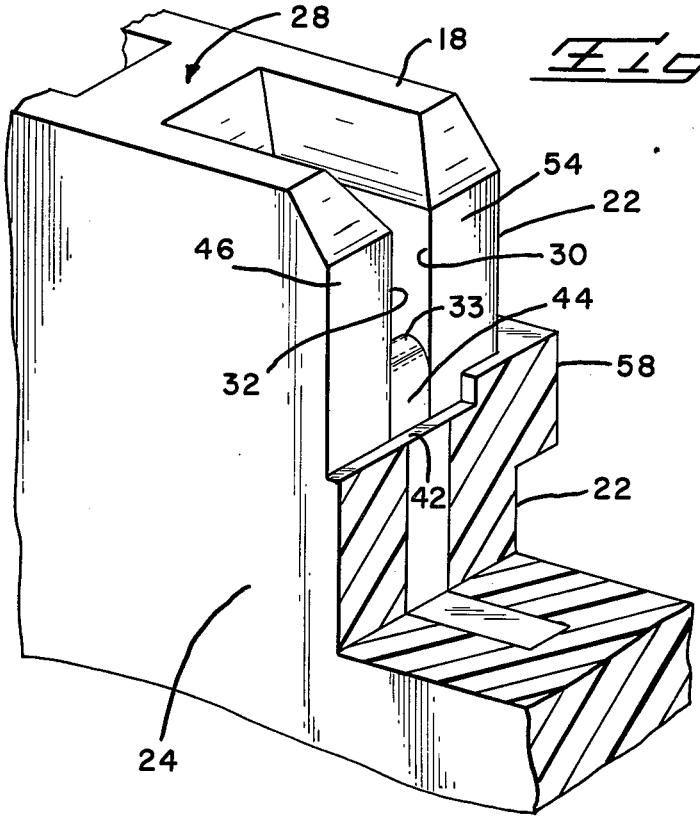
FIG. 2 is a cut away fragmentary perspective view of a housing showing details of a terminal-receiving cavity.

The cavity 20 has internal front and back sidewalls 30, 32, the front sidewall 30 being proximate to the external sidewall 22 and the back sidewall 32 being proximate to external sidewall 24 as shown in FIG. 2. Cavity 20 has opposed internal endwalls 34, 36 which are proximate to the housing endwalls 26, 28 respectively. The internal walls of the cavity extend to the inner end of the cavity 38 as shown in FIGS. 3 and 4.

A rib 40 extends transversely across the cavity 20 and between the internal sidewalls 30, 32, the upper end 33 of this rib being spaced from the terminal-receiving surface 18 of the housing. A wire-supporting ledge 42 is provided on one side surface of the rib 40 between the upper end 33 of the rib and the inner end 38 of the cavity so that the side surface of the rib has one portion 44 thereof which extends from the ledge to the inner end 38 of the cavity.

Figure 3:
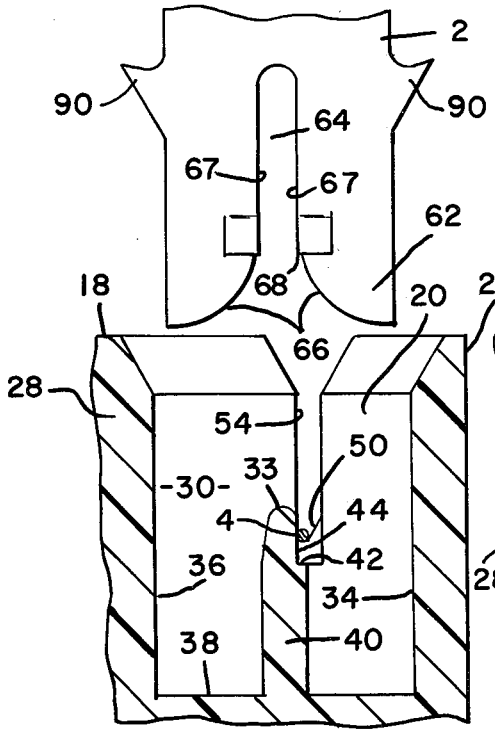
FIG. 3 is a cross-sectional view of the housing looking in the direction of the arrow 3 of FIG. 1 and showing terminal in alignment with the terminal-receiving cavity.
Figure 4:
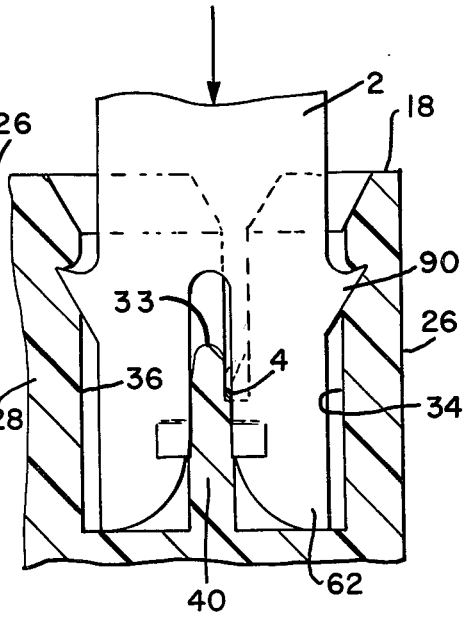
FIG. 4 is a view similar to FIG. 3 but with the terminal in its fully inserted position.

Wire-admitting slot means 46, 54 are provided in the back sidewall and front sidewall respectively, and communicate with the cavity as shown in FIG. 3. The slot 54 in the front sidewall 22 is of a width which is greater than the diameter of the wire but at the inner end, one side portion of the wire-admitting slot extends obliquely as shown at 50 towards the inner end of the slot and the inner end of the slot is relatively narrow so that the wire will be accurately positioned therein as shown in FIG. 3. It will be noted in FIG. 3 that this inner end of the slot 54 is between the ledge 42 and the outer end 33 of the rib. The slot 46 in the sidewall 24 also has an inner end as shown in FIG. 2, which is co-planar with the ledge 42. It will thus be apparent that when a wire is positioned in the slots 46, 54, it will extend diagonally across the upper portion 44 of the rib 40 and will be spaced from the ledge 42. The end of the wire is wound on a severable binding post 58 as shown in FIG. 1. This binding post is located adjacent to the inner end of the slot 54.

The terminal 2 comprises a flat stamped member which is dimensioned to be inserted into the cavity 20 and has a leading end 62 which is first to enter the cavity during insertion as shown in FIG. 1. A slot 64 extends into the terminal from this leading end 62, the entrance portions of the slot extending arcuately as shown at 66 to a portion which has a substantially uniform width and parallel edges 67. A very narrow shoulder 68 is provided adjacent to the juncture of the arcuate and straight edge portions 66, 67 of the slot, the width of the shoulder being slightly greater than the thickness of the insulating coating on the wire, as will be described below.

The shoulders 68 are produced on the terminal by the manufacturing steps shown in FIGS. 5-8 which may be carried out in the progressive die in which the terminal is manufactured. Referring to FIG. 5, during manufacture the terminal is sheared along shear lines 70, 72 the shear line 70 extending inwardly from the edge of the slot and the shear line 72 extending normally from the end of the shear line 70 and away from the lead end 62. After this shearing step has been carried out, a portion 76 will extend obliquely downwardly from the plane of the blank and below the lower surface 84 of the blank. The sheared edges to the left in FIG. 6 of the shear line 70 will have a smooth portion 78 extending downwardly from the upper surface 82 of the blank and an irregular surface portion 80 extending from the end of a portion 78 to the lower surface 84 of the blank. This smooth and rough surface phenomenon will also be present along the surface produced by the shear along line 72. The displaced portion 76 of the blank in FIG. 6 will have a smooth surface portion 88 adjacent to the downwardly facing surface 89 and will have a roughened irregular surface 86 adjacent to upwardly facing surface 91 of the section 76. These smooth and roughened surfaces shown in FIG. 6 are produced in all shearing operations for the reason that when metal is sheared by two shearing dies, the metal first yields stretches and is deformed without fracture in the direction of shear. After a significant predetermined amount of this stretching has taken place, the metal abruptly fractures along the shear lines as the result of work hardening and failure. The smooth surfaces 78, 88 are produced during plastic deformation of the material; that is by movement of the section 76 out of the plane of the blank and prior to fracture of the metal. The roughened surfaces 80, 86 are produced when the metal fractures. After the shearing operation has been carried out, the portion 76 of the blank is moved upwardly from the position of FIG. 6 until it lies substantially in the original plane of the blank as shown in FIG. 7. However, because of the smooth and roughened surfaces 78, 80, 86, and 88, the section 76 of the blank cannot be fitted into the outlines or boundaries defined by the shear lines 70,72 and the portion 76 will project outwardly by a minor amount as shown in FIG. 8, thereby producing the shoulder 68.

The terminal 2 may be produced as a continuous strip if desired, and inserted into the cavity 16 with automatic insertion machinery. The terminal as shown has lances 90 to retain it in the housing after insertion and it has an end 92 which is dimensioned to be mated with a quick disconnect type terminal crimped on the end of a wire thereby to connect the end of a wire 4 to a lead wire. When desired, terminating means may be used for this connection of the terminal to a lead wire such as a post for a wrap type connection or a solder post.

In use, and after the coil 6 has been wound on the bobbin, the ends of the wire are laid in slots 60 in the flange 12 which are in alignment with the slots 46, 46'. The wires are also placed in the slots 54, 54' and wrapped around the binding posts 58, 58'. The terminals are inserted into the housings as shown in FIGS. 3 and 4 are immediately prior to insertion the binding posts 58, 58' are cut from the housing block so that the wires are cut in the plane of the external front walls 22, 22' of the housing. As the terminals move into the housings the shoulders 68 engage the wires and move them downwardly to the ledges 42 on the ribs 40. These shoulders, as they move post the wires penetrate the insulation so that the inner edge portions 67 establish contact with the wires. The cut ends of the wires are drawn into the cavities and are not, therefore, exposed. The insertion apparatus may be of the class described in application Ser. No. 874,958 in that a cutting blade is moved in advance of the terminal to cut the binding posts from the housing prior to engagement of the terminals with the wires. After cutting of the wires and the binding posts, the ends of the wires are free and they can be dragged by the terminals partially into the housings and against the ledges 42.

The successful practice of the invention requires the penetration of the insulation of the wire by the shoulder 68 and the establishment of electrical contact between the wire and the edge portions 67 of the slot. As indicated in FIGS. 3 and 4, the rib 40 has a width slightly greater than the width of the slot 60 so that the terminal is stressed during insertion, that is, the portions on each side of the slot 64 are flexed away from each other and their tendency to return to their normal positions ensures and maintenance of contact pressure between the wire and the edge 67.

Figure 9:
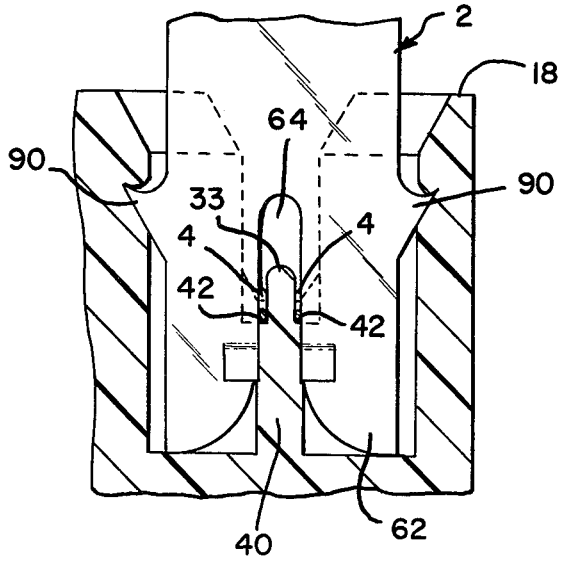
FIG. 9 is a view similar to FIG. 3 of an alternative embodiment.

In general, the embodiment shown in FIG. 1 and the embodiment of FIG. 9 are intended for an establishing electrical contact with relatively fine wires, for example, AWG 32 and finer. Successful practice of the invention requires that certain principles be observed with regard to the dimensions of the critical elements such as the wire, the ledge 42, and the shoulder 68. The width of the shoulder 68 on the terminal must be greater than the thickness of the varnish-type insulating coating on the wire and must be significantly less than the diameter of the wire. As a practical matter, a shoulder 68 having a width of 0.0254±0.0127 mm can be produced where the material of the terminal is hardened brass which has a thickness of 0.254 mm. The insulating coatings on relatively fine wires is usually about 0.0076 mm and may be less than this so that the minimum width of the shoulder 68, 0.0127 mm, will be greater than the thickness of the insulating coating.

The ledge 42 in the housing serves as a stop for the wire in that it prevents the wire from moving downwardly beyond the position of FIG. 4 so that the contact edge 67 of the terminal 2 will move past the wire and establish electrical contact when the terminal is fully inserted. If the ledge 42 has a width which is substantially greater than the diameter of the wire, the edge 67 of the terminal may not contact the wire. On the other hand, the wire has a diameter which is greatly in excess of the width of the ledge 42, the shoulder 68 may sever the wire during downward movement of the terminal and no electrical contact will be obtained.

Other factors will enter into the achievement of optimum results. For example, the housing is preferably produced by injection molding of a thermoplastic material, such as nylon, to which glass fibers have been added to increase the hardness of the material. The housing is compressed to some extent as shown by FIGS. 3 and 4 and the degree to which it is compressed may affect the optimum dimensions for the width of the shoulder or ledge 42 relative to the diameter of the wire. Also, the terminal is resiliently deformed by the rib 40 and its physical properties (hardness and elastic modulus), the depth of the slot 64, and the thickness of the material from which it is made will affect the performance of the connecting system.

By way of specific example, good results have been attained in making electrical connections to AWG 38 wires having a diameter "D" of 0. 1016 mm and having an insulating coating such that the overall D' diameter including the insulation is 0.1143 mm, if the ledge 42 has a width of at least 0.4D' and no greater than D'-0.0254 mm. If the ledge has a width which is significantly less than 0.4D', the wire may be cut during insertion of the terminal by the shoulder 68 and if the ledge has a width which is greater than D', electrical contact maybe obtained for the reason that the edge 67 may not contact the wire. These relationships for an AWG 38 wire were determined as a result of extensive work in which the housing was of a glass filled nylon material, the terminal 2 was of a hardened brass having a thickness of 0.254 mm, the rib 40 had a width below the ledge 42 of 0.508 mm and the slot 64 had a width of 0.4318 mm between the edges 67 above the shoulder 68. The shoulders had a nominal width of 0.0254 mm with a tolerance range of ±0.0127 mm.

FIG. 9 shows a housing in which a ledge 42 is provided on each side surface of the central rib 40 so that two electrical connections between the terminal 2 and one or two fine wires can be achieved. This embodiment may be used when a second electrical connection to one wire is desired for purposes of redundancy, or it can be used where the terminal is to be connected to two wires, for example, when coils are connected to each other in series.

FIGS. 10–14 show an alternative embodiment comprising housings 94, 94' which form a housing block 94 which is integral with the flange 12 of the bobbin. The housings are identical and only the housing on the right is described in detail.

The housing 94 has a terminal-receiving surface 96 and a terminal-receiving cavity 97 extending into the surface 96. The housing comprises front and back external sidewalls 98, 100, an external endwall 102 and a common endwall 104 for both of the housings. The back sidewall 100 is integral with the flange 12.

Figure 12:
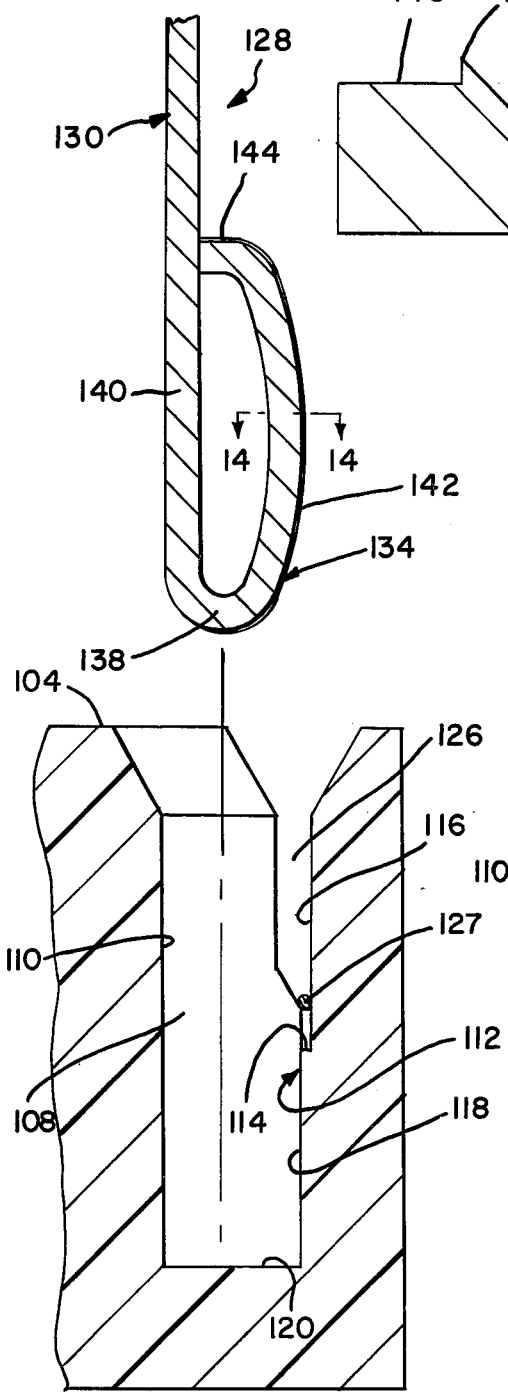
FIG. 12 is a transverse view of the housing showing the terminal in alignment with the terminal-receiving cavity.
Figure 13:
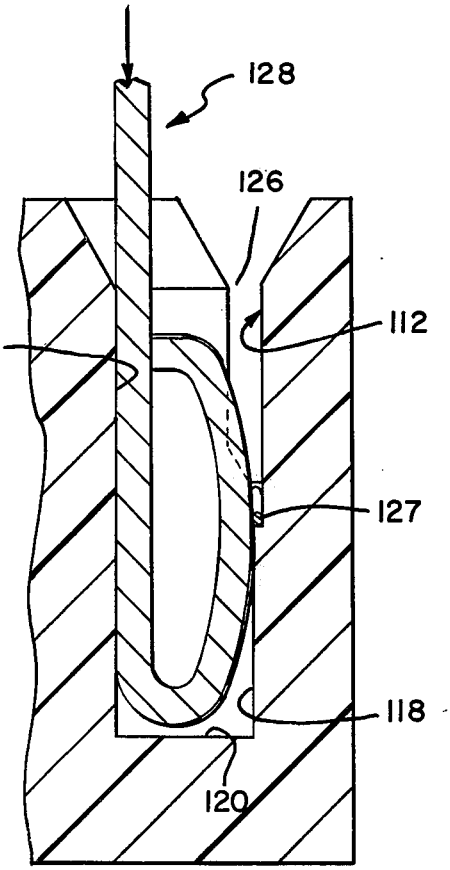
FIG. 13 is a view similar to FIG. 12 but showing the terminal in its fully inserted position and in electrical contact with the wire.

As shown in FIGS. 11–13, the cavity has front and back internal sidewalls 106, 108 which are proximate to the external front and back sidewalls and opposed internal endwalls 110, 112. A ledge 114 is provided on the endwall 112 and the upper portion 116 of this endwall extends towards the surface 104 while the lower portion 118 extends from the ledge 114 to the inner end 120 of the cavity. A slot 122 is provided in the back sidewall and is generally similar to the previously described slot in the embodiment of FIG. 1. The inner end of this slot 124 is between the ledge 114 of the surface 104. A slot 126 is provided in the front sidewall having an inner end 127 which is above the ledge as viewed in FIG. 12. A removably binding post 58 is provided on the front sidwall adjacent to the inner end of the slot 126 so that the wire can be wound on this binding post after it has been placed in the slot.

The terminal 128 comprises an elongated strip 130 of conductive spring metal such as brass having a tab 132 at one end and a contact terminal 134 at its other end. The tab 132 is dimensioned to receive, and be mated with, a receptacle terminal which is crimped or otherwise secured to a lead wire.

The contact terminal 134 comprises a flat spring support portion 140, a reverse bend 138 at the leading end of the terminal, an arcuate contact spring portion 134, and in inwardly formed end 144 which extends normally towards the surface of the elongated strip. Lances extend laterally from the support portion 134 as shown at 136 for retaining the terminal in the cavity.

Figure 14:
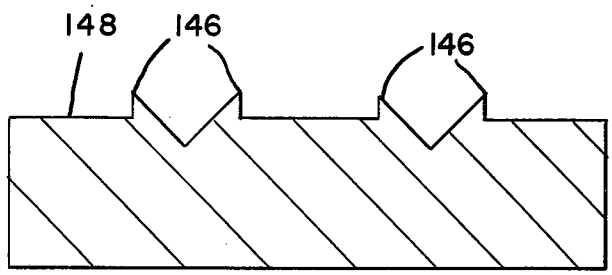
FIG. 14 is a view taken along the lines 14—14 of FIG. 12.

As shown in FIG. 14, the surface of the arcuate spring portion 134 is provided with spaced-apart ribs which have relatively sharp parallel peaks 146 which are elevated above the convex surface 148 of the spring portion. These peaks are formed by passing a sharp tool across the surface of the stock metal prior to forming. This operation, which is analogous to argicultural plowing produces a furrow between the peaks 146. The elevation of the sharp peaks 146 above the surface 148 is greater than the thickness of the insulating coating on the wire, for example, greater than about 0.0254 mm but is substantially less than the diameter of the wire.

The contact terminal is generally D-shaped in the disclosed embodiment and the arcuate portion comprises a resiliently deformable spring member which is dimensioned such that it will have a force fit in the cavity.

In use, the ends of the coil wire are led through the slots in the housing sidewall and located against the surface portions 116, 116' with their end portions extending through the slots in the front sidewall and wound around the binding posts. Immediately prior to insertion of the terminals into the cavities, the binding posts are cut off as explained above so that the cut ends of the wires can be drawn into the cavities. The wires are retained on the ledges 114 and as the convex surface 148 moves past the sharp peaks 146 penetrate the insulation of the wire and establish electrical contact with the wires.

In general, the width of the ledge 114 relative to the diameter of the wire should be in accordance with the principles discussed above with relation to the previously described embodiment.

I claim:

1. Electrical connecting means for establishing electrical contact with a wire having a thin film insulating material thereon and comprising an insulating housing having a terminal-receiving surface and a terminal-receiving cavity extending into said terminal-receiving surface, said cavity having an inner end which extends parallel to said terminal-receiving surface and said cavity having internal walls which extend from said inner end towards said terminal-receiving surface, wire-admitting slot means in said housing, said wire-admitting slot means extending from said terminal-receiving surface and communicating with said cavity, wire-supporting means in said cavity for supporting a wire extending through the wire-admitting slot means with the axis of said wire extending transversely across said cavity, and a terminal dimensioned to be inserted into said cavity, said terminal having insulating penetrating and contact surface portions which are engageable with said wire upon insertion of said terminal into said cavity, said connecting means being characterized in that:

said wire-supporting means comprises a wire-supporting ledge on one of said internal walls of said cavity, said ledge extending transversely across said one internal wall and being in alignment with said wire-admitting slot means, said ledge extending parallel to the axis of a wire positioned said wire-admitting slot means, said one internal wall having one surface portion which extends from said ledge towards said terminal-receiving surface and a second surface portion which extends from said ledge away from said terminal-receiving surface and to said inner end of said cavity, said terminal being dimensioned to have a force fit of said insulating penetrating and contact surface portions against a wire supported on said ledge when said terminal is inserted into said cavity, said ledge having a width which is substantially no greater than the diameter of said wire and which is sufficient to prevent movement of said wire laterally of its axis past said ledge and across said second surface portion of said one internal wall during insertion of said terminal into said cavity whereby, upon placement of said wire in said wire-admitting slot means and insertion of said terminal into said cavity, said insulation penetrating and contact surface portions of said terminal move over said wire and establish electrical contact therewith.

2. Electrical connecting means as set forth in claim 1, said internal walls comprising parallel spaced-apart sidewalls, said wire-admitting slot means comprising wire-admitting slots in said sidewalls, said slots having inner ends which are between said ledge and said terminal-receiving surface whereby said wire is spaced from said ledge and upon insertion of said terminal into said cavity, said wire is initially moved to said ledge.

3. Electrical connecting means as set forth in claim 2, said terminal comprising a plate-like member, said insulation penetrating and contact surface being on one edge of said plate-like member.

4. Electrical connecting means as set forth in claim 3, said plate-like member having a leading end which is first to enter said cavity during insertion of said terminal into said cavity, said one edge of said plate-like member having a shoulder thereon which faces said leading end, said shoulder constituting said insulation penetrating portion of said terminal, portions of said one edge which extend from said shoulder away from said leading end constituting said contact surface portions.

5. Electrical connecting means as set forth in either of claims 3 or 4, said internal walls comprising opposed sidewalls and opposed endwalls, and a centrally located rib extending from said inner end of said cavity and between said sidewalls, said ledge being on one side suface of said rib, said terminal having a slot extending therein from said leading end, said slot being dimensioned to receive said rib, said one edge of said terminal comprising one edge of said slot.

6. Electrical connecting means as set forth in claim 5, said rib having a second ledge on the other side surface thereof, the other edge of said slot in said terminal having a shoulder therein and second wire-admitting slot means in said sidewalls whereby, a seond electrical contact with a wire can be established.

7. Electrical connecting means as set forth in claim 1, said terminal having an arcuate portion and being dimensioned for insertion into said terminal-receiving cavity parallel to the chord of said arcuate portion, said insulation penetrating and contact portions being on the convex surface of said arcuate portion, and arcuate portion being resiliently deformable during insertion into said cavity whereby said insulation penetrating and contact surface portions and maintained in contact with said wire after insertion.

8. Electrical connecting means as set forth in claim 7, said terminal comprising an elongated metal strip which has a reverse bend therein, said arcuate portions extending from said reverse bend.

9. Electrical connecting means as set forth in claim 8, said terminal being generally D-shaped and having flat portions extending to said reverse bend, said arcuate portions extending from said reverse bend, said strip having a free end which is spaced from said reverse bend and which extends substantially normally of said flat portion whereby said free end bears against said flat portion upon resilient flexure of said arcuate portion.

10. Electrical connecting means as set forth in claim 9, a rib having a pointed peak extending over said convex surface in the direction of insertion of said terminal into said cavity, said peak sufficient to penetrate said insulating film.

* * * * *